United States Patent [19]

Shibazaki et al.

[11] 4,240,870

[45] Dec. 23, 1980

[54] FILLED PAPER

[75] Inventors: Hiroji Shibazaki, Takarazuka; Setsuji Edagawa; Hisashi Hasegawa, both of Nishinomiya, all of Japan

[73] Assignee; Shiraishi Kogyo Kaisha, Ltd., Amagasaki, Japan

[21] Appl. No.: 74,317

[22] Filed: Sep. 11, 1979

[30] Foreign Application Priority Data

Sep. 13, 1978 [JP] Japan ..... 53-113423

[51] Int. Cl.[3] ..... D21H 3/78

[52] U.S. Cl. ..... 162/181 A

[58] Field of Search ..... 106/288 B, 306; 162/181 R, 181 A; 423/432

[56] References Cited

U.S. PATENT DOCUMENTS

| | | | |
|---|---|---|---|
| 1,372,193 | 3/1921 | Roon | 423/432 |
| 2,538,802 | 1/1951 | Schur | 423/432 |
| 3,133,824 | 5/1964 | Podschus | 423/432 |
| 4,018,877 | 4/1977 | Woode | 423/432 |
| 4,124,688 | 11/1978 | Shibazaki et al. | 423/432 |
| 4,133,894 | 1/1979 | Shibazaki et al. | 423/432 |
| 4,157,379 | 1/1979 | Arika et al. | 423/432 |

*Primary Examiner*—Peter Chin

*Attorney, Agent, or Firm*—Bierman & Bierman

[57] ABSTRACT

The filled paper is filled with at least one of (i) a calcium carbonate in the form of particles comprising a core about 0.5 to about 6.5 μm in average diameter and about 100 to about 4000 projections formed on the surface of the core and having a length (L) of about 0.25 to about 2.00 μm, a diameter (D) of about 0.08 to about 0.20 μm and an aspect ratio (L/D) of about 3 to about 10, the calcium carbonate having a void volume of about 1.0 to about 1.8 ml/g and an oil absorption of about 45 to about 60 ml/100 g, and (ii) a calcium carbonate in the form of particles comprising a core about 0.2 to about 2.0 μm in average diameter and about 100 to about 4000 projections formed on the surface of the core and having a length (L) of about 0.15 to about 4.00 μm, a diameter (D) of about 0.05 to about 0.20 μm and an aspect ratio (L/D) of about 3 to about 20, the calcium carbonate having a void volume of about 1.8 to about 3.3 ml/g and an oil absorption of about 50 to about 100 ml/100 g.

The paper has increased stiffness and enhanced opacity with reduced weight.

4 Claims, No Drawings

FILLED PAPER

This invention relates to filled paper, and more particularly to filled paper having high stiffness and opacity despite its lightness and reduced thickness and to a process for producing the paper.

It has been desired to provide papers of reduced weight including filled papers. Generally a reduction in the thickness of paper to make the paper lighter leads to decreased opacity and increased transparency. Enhanced opacity can be given to paper usually by the use of pigments of high hiding power, whereas paper will invariably have reduced stiffness when filled with known pigments such as clay, titanium white, barium sulfate, calcium carbonate in the form of spindle-shaped crystals, etc. Thus it has been considered impossible to provide thin light paper of increased opacity without substantially reducing the stiffness of paper.

The main object of this invention is to provide filled paper having increased stiffness and enhanced opacity but reduced weight.

Another object of the invention is to provide a process for producing filled paper having increased stiffness and enhanced opacity but reduced weight.

Other objects and features of the invention will become more apparent from the following description.

The present invention provides a filled paper characterized in that the paper is filled with at least one of (a) a calcium carbonate in the form of particles comprising a core about 0.5 to about 6.5 μm in average size and about 100 to about 4000 projections formed on the surface of the core and having a length (L) of about 0.25 to about 2.00 μm, a diameter (D) of about 0.08 to about 0.20 μm and an aspect ratio (L/D) of about 3 to about 10, the calcium carbonate having a void volume of about 1.0 to about 1.8 ml/g and an oil absorption of about 45 to about 60 ml/100 g (hereinafter referred to as "calcium carbonate A"), and (b) a calcium carbonate in the form of particles comprising a core about 0.2 to about 2.0 μm in average size and about 100 to about 4000 projections formed on the surface of the core and having a length (L) of about 0.15 to about 4.00 μm, a diameter (D) of about 0.05 to about 0.20 μm and an aspect ratio (L/D) of about 3 to about 20, the calcium carbonate having a void volume of about 1.8 to about 3.3 ml/g and an oil absorption of about 50 to about 100 ml/100 g (hereinafter referred to as "calcium carbonate B"). The invention also provides a process for producing the filled paper.

The term "core" as used in the specification and the claims refers to a spherical, ellipsoidal or egg-shaped body, a cube or rectangular parallelepiped having round corners and ridges, or a block resembling such body. The core may have a sponge-like porous structure in its interior. By the term "average diameter of the core" is meant the diameter of a sphere having the same volume as the core. By the term "average diameter of the projection" is meant the diameter of a cylinder identical with the projection in length and volume.

Calcium carbonate A and calcium carbonate B is the subject of invention of U.S. Patent Application Ser. No. 23,962.

We have carried out further research on the calcium carbonate A and calcium carbonate B in an attempt to use these products as fillers for paper, directing attention to their unique physical and chemical properties as distinct from those of the known calcium carbonate particles. Consequently we have found that paper, when filled with these carbonates, has greatly enhanced opacity while retaining substantially high stiffness. The present invention has been accomplished based on this novel finding.

The calcium carbonate A and calcium carbonate B used in the invention will be described below.

Calcium carbonate A

Observation under an electron microscope has revealed that particles of the calcium carbonate A have a peculiar shape that a block-like core is provided with a large number of projections over the periphery thereof. Since the projections have no portions which are joined together or connected in the form of a chain longitudinally thereof, the projections per se have exceedingly high strength, and the particles are also tough in themselves. Accordingly even when the calcium carbonate A is treated for example by a pulverizer of the impact type, projections may be fractured partially but the cores will remain intact.

The calcium carbonate A of this invention generally has the chemical composition given in Table 1 and the physical properties listed in Table 2 which also shows those of known calcium carbonates.

TABLE 1

| | |
|---|---|
| CaO | 53.5–55.4% by weight |
| $P_2O_5$ | 0.007–3.5% by weight |
| Ig. loss | 43–44% by weight |
| Miscellaneous | 0.02–0.7% by weight |

TABLE 2

| | | Commercial calcium carbonate | | |
|---|---|---|---|---|
| | Calcium carbonate A | I[1] | II[2] | III[3] |
| Shape of particles | With projections | Needle-like | Cubic | Indefinite |
| Projections | | | | |
| Number | 100–4000 | — | — | — |
| Length (L,μm) | 0.25–2.00 | — | — | — |
| Diam. (D,μm) | 0.08–0.20 | — | — | — |
| Aspect ratio (L/D) | 3–10 | — | — | — |
| Water absorption (g/g) | 0.07–1.20 | 1.29 | 1.02 | 0.57 |
| Angle of repose (deg) | 30–40 | 37 | 46 | 46 |
| Specific surface area ($m^2/g$) | 5–15 | 4.0 | 26.0 | 2.5 |
| Oil absorption (ml/100 g) | 45–60 | 40 | 27 | 20 |
| Void volume (ml/g) | 1.0–1.8 | 1.00 | 1.10 | 0.60 |
| Sedimentation volume (ml/60 min) | 20–50 | 18 | 95 | 12 |
| Hiding power ($cm^2/g$) | 25–33 | 21.0 | 13.8 | 13.9 |

TABLE 2-continued

| | Calcium carbonate A | Commercial calcium carbonate I[1] | II[2] | III[3] |
|---|---|---|---|---|
| Viscosity (cps/60 wt. %) | 20-100 | 74 | 3800 | 26 |

Note:
[1]Light calcium carbonate.
[2]Colloidal calcium carbonate.
[3]Ground calcium carbonate.

The physical properties listed in Table 2 et seq. are determined by the following methods.

(1) The number, length and diameter of projections: Measured under an electron microscope.

(2) Water absorption: A water absorption measuring device is placed with its base positioned horizontally. A specimen container provided at its bottom with a sheet of filter paper 43 mm in diameter is fitted into a recess in the base with an intermediate cylinder fitted in the container. A specified quantity of the specimen weighed out on an even balance is placed into the container through the cylinder and levelled over the surface. The piston of the device is quietly inserted into the container along the inner surface of the cylinder and pressed against the specimen. With the piston held in its inserted position, the cylinder is removed from the base, and the container with the specimen therein is also removed from the base and then weighed on the even balance. The weight measured is assumed to be $X_1$. Subsequently the specimen container is quietly placed into a glass dish filled with water to a depth of 4 mm. Ten minutes after the specimen has been wetted with the water over the entire surface, the container is withdrawn from the dish and allowed to stand for 5 minutes on 5 superposed sheets of filter paper. Immediately after the water has been wiped off from the bottom and side surface of the container with filter paper, the container is weighed. The weight measurement is assumed to be $X_2$, and the amount of water absorbed by the bottom filter paper, a constant value of 0.3 g. The water absorption is calculated from the following equation down to the second decimal place.

$$\text{Water absorption (g/g)} = \frac{(X_2\,(\text{g}) - X_1\,(\text{g})) - 0.3\,(\text{g})}{\text{Weight of specimen (g)}}$$

(3) Angle of repose: The specimen is poured onto a disk having a diameter (D=80 mm) through a funnel positioned above the disk concentrically therewith to form a conical accumulation of the specimen. The height (H mm) of the cone is measured. The angle of repose, $\theta$, is given by $$\tan\theta = \frac{2H}{D} = \frac{2H}{80}.$$

(4) Specific surface area: According to the BET method using $N_2$.

(5) Oil absorption: According to JIS K 5101.

(6) Void volume: Measured by a mercury porosimeter.

(7) Hiding power: According to JIS K 5101.

(8) Sedimentation volume: A 5-gram quantity of the specimen is placed into a 100-ml measuring cylinder, and water is added to the specimen to obtain 100 ml of a mixture. The sedimentation volume is measured after shaking the mixture for 20 seconds and allowing the same to stand for 60 minutes.

(9) Viscosity: A commercial sodium polyacrylate dispersant (0.5 part by weight) is added to 100 parts by weight of 60% by weight aqueous dispersion of the specimen, and the viscosity of the mixture is measured by Brookfield type viscosimeter at 60 r.p.m. A 50% by weight aqueous suspension is used for the commercial product II which is highly viscous.

Table 2 indicates that the calcium carbonate A of this invention is very useful as a pigment for coating papers and other articles and a filler for making papers and plastics materials.

The calcium carbonate A of this invention is prepared by the following processes.

(i) An aqueous calcium hydroxide suspension is prepared which has a concentration of about 5 to about 15% by weight and contains at least one of phosphoric acid and water-soluble salts thereof in an amount of about 0.01 to about 5.0 parts by weight, calculated as $P_2O_5$, per 100 parts by weight of the calcium hydroxide. The phosphoric acid may be any of orthophosphoric acid, metaphosphoric acid, hexametaphosphoric acid, tripolyphosphoric acid, pyrophosphoric acid, tetrapolyphosphoric acid, hexapolyphosphoric acid, etc. The water-soluble salt may be any of sodium, potassium, zinc and like salts of these phosphoric acids. The suspension is sprayed into a reactor in the form of droplets about 0.2 to about 1.0 mm in diameter at a temperature of about 30 to about 80° C. in countercurrent relation to a carbon dioxide-containing gas which is passed upward through the reactor at a superficial velocity of about 0.02 to about 1.0 m/sec to convert about 5 to about 25% of the calcium hydroxide to calcium carbonate and produce uniform crystals in the form of bundled threads and servings as bases for the desired particles of calcium carbonate to be obtained. When less than 0.01 parts by weight, calculated as $P_2O_5$, of the phosphoric acids and water-soluble salts thereof are used in the first step per 100 parts by weight of the calcium hydroxide, the calcium carbonate particles finally obtained will not have satisfactory projections, whereas when the amount exceeds 5.0 parts by weight, the resulting product will contain particles other than those having projections. It is more preferable to use the phosphoric acids and water-soluble salts thereof in an amount of about 0.02 to about 3.0 parts by weight, calculated as $P_2O_5$, per 100 parts by weight of the calcium hydroxide. If the aqueous suspension has a calcium hydroxide concentration of less than 5% by weight or a temperature of lower than 30° C., the calcium carbonate finally obtained will be in the form of chain particles or of block-like secondary particles which are agglomerates of fine cubic particles of up to 0.1 μm. If the calcium hydroxide concentration is above 15% by weight, difficulty is encountered in spraying the suspension in uniform droplets, giving a final product in particle sizes of reduced uniformity. When the temperature is higher than 80° C., there is a pronounced tendency that the product will contain large particles of undesirable shape. When the suspension is sprayed in droplets of larger than 1.0 mm in diameter, the reaction fails to proceed uniformly, giving a final product in uneven particle sizes, whereas droplets smaller than 0.2 mm tend to flow out from the reactor as entrained in the carbon dioxide-containing gas. The carbon dioxide-containing gas, if passed through the reactor at a superficial velocity of lower than 0.02 m/sec, will not permit the reaction to proceed smoothly, whereas velocities higher than 1.0 m/sec tend to permit droplets of the suspension to flow out from the system. The carbon dioxide concentration of the gas, although not particularly limited, is likely to impede rapid reaction when below 10% by volume, while concentrations above 40% by volume will not noticeably favor the reaction. In view of reactivity and economy, it is more preferable that the carbon dioxide concentration be about 20 to about 35% by volume.

(ii) In the second step, the mixture resulting from the first step is sprayed into a second reactor in droplets of about 1.0 to about 2.0 mm in diameter at a temperature of about 30 to about 80° C. in countercurrent relation to a carbon dioxide-containing gas passed upward through the reactor at a superficial velocity of about 0.5 to about 2.5 m/sec to effect the carbonation to about 95 to about 98%, whereby the crystals produced in the first step and resembling bundles of threads are gathered into portions substantially corresponding to the cores of the final product. The second-step reaction is carried out substantially under the same conditions as in the first step. Since the bundled thread-like crystals have already been formed in the first step, the mixture is sprayed in larger droplets, with the gas passed at a correspondingly higher superficial velocity.

(iii) In the third step, the mixture from the second step is sprayed into a third reactor at a temperature of about 30 to about 80° C. in droplets of about 1.5 to about 2.0 mm in diameter in countercurrent relation to a carbon dioxide-containing gas which is passed upward through the reactor at a superficial velocity of about 1.5 to about 3.0 m/sec to complete the carbonation. The reaction affords calcium carbonate A in the form of particles comprising a core and projections formed over the surface of the core. Since the third step needs only to complete the carbonation which has already proceeded greatly, the mixture from the second step is sprayed in slightly larger droplets with the carbon dioxide-containing gas fed also at an increased superficial velocity while other conditions are substantially the same as in the first step reaction. The calcium carbonate A produced according to this invention is collected from the reaction mixture in a usual manner as by a filter press, vacuum filter or the like, dried, divided into loose particles and classified to obtain particles of desired size.

The calcium carbonate A of this invention can be produced also by conducting the first step with use of an aqueous suspension containing about 5 to about 15% by weight of calcium hydroxide, adding at least one of the above-specified phosphoric acids and water-soluble salts thereof to the mixture resulting from the first step in an amount of about 0.01 to about 5.0 parts by weight, calculated as $P_2O_5$, per 100 parts by weight of the solids and subsequently performing the second and third steps. This process may be practiced under the same conditions as above with the exception of when to add the phosphoric compound.

Calcium carbonate B

Observation under an electron microscope has revealed that the particles of the calcium carbonate B comprise a block-like core having a large number of projections formed over the periphery thereof. Since the projections have no portions which are joined together or connected in the form of a chain longitudinally thereof, the projections per se have exceedingly high strength, and the particles are also tough in themselves. Accordingly even when the calcium carbonate B is treated for example by a pulverizer of the impact type, projections may be fractured partially but the cores will remain intact.

The calcium carbonate B of this invention generally has the chemical composition given in Table 3 and the physical properties listed in Table 4 which also shows those of known calcium carbonates.

TABLE 3

| | |
|---|---|
| CaO | 48.5–55.4% by weight |
| Ig. loss | 43.0–51.0% by weight |
| Miscellaneous | 0.02–0.07 by weight |

TABLE 4

| | Calcium carbonate B | Commercial calcium carbonate I[1] | II[2] | III[3] |
|---|---|---|---|---|
| Shape of particles | With projections | Needle-like | Cubic | Indefinite |
| Projections | | | | |
| Number | 100–4000 | — | — | — |
| Length (L,μm) | 0.15–4.0 | — | — | — |
| Diam. (D,μm) | 0.05–0.2 | — | — | — |
| Aspect ratio (L/D) | 3–20 | — | — | — |
| Water absorption (g/g) | 1.0–2.3 | 1.29 | 1.02 | 0.57 |
| Angle of repose (deg) | 45–60 | 37 | 46 | 46 |
| Specific surface area ($m^2/g$) | 8–20 | 4.0 | 26.0 | 2.5 |
| Oil absorption (ml/100 g) | 50–100 | 40 | 27 | 20 |
| Void volume (ml/g) | 1.8–3.3 | 1.00 | 1.10 | 0.60 |
| Sedimentation volume (ml/60 min) | 50–70 | 18 | 95 | 12 |
| Hiding power ($cm^2/g$) | 30–50 | 21.0 | 13.8 | 13.9 |
| Viscosity (cps/60 wt. %) | 100–1000 | 74 | 3800 | 26 |

Note:
[1]Light calcium carbonate,
[2]Colloidal calcium carbonate,
[3]Ground calcium carbonate.

Table 4 indicates that the calcium carbonate B of this invention is highly amenable to absorption of oil and to sedimentation, has a large void volume and high rigidity and is therefore very useful as a filler and pigment for plastics, rubbers, papers and like materials.

The calcium carbonate B of this invention is prepared by the following process.

(i) An aqueous suspension is prepared which has a calcium hydroxide concentration of about 5 to about 15% by weight and contains about 0.01 to about 20 parts by weight of at least one additive per 100 parts by weight of the calcium hydroxide, the additive being selected from the group consisting of (a) hydroxycarboxylic acids and water-soluble salts thereof, (b) aminopolycarboxylic acids and water-soluble salts thereof, and (c) water-soluble salts of a copolymer of 100 moles of isobutylene and 80 to 150 moles of maleic anhydride. (The copolymer will be hereinafter referred to as "IM copolymer".) Examples of useful hydroxycarboxylic acids are citric acid, tartaric acid and malic acid, and examples of useful water-soluble salts thereof are alkali metal salts and ammonium salts. Examples of useful aminopolycarboxylic acids are iminodiacetic acid, nitrilotriacetic acid and ethylenediaminetetraacetic acid, and examples of useful water-soluble salts thereof are alkali metal salts and ammonium salts. Examples of useful IM copolymers are those usually having a molecular weight of about 10,000 to about 30,000. They are used in the form of water-soluble salts such as alkali metal salts and ammonium salts. IM copolymers lower than 10,000 in molecular weight are difficult to industrially produce, whereas the use of those having a molecular weight of higher than 30,000 will give particles of calcium carbonate with projections having an aspect ratio (L/D) of less than 3, failing to afford the desired calcium carbonate. Examples of more preferably IM copolymers are those prepared by reacting isobutylene with maleic anhydride in the ratio of about 100 to about 120 moles of the latter per 100 moles of the former and having a molecular weight of about 15,000 to about 20,000. The suspension is passed downward through a reactor at a temperature of about 30° to about 80° C. in countercurrent relation to a carbon dioxide-containing gas passed upward through the reactor at a superficial velocity of about 0.02 to about 1.0 m/sec to covert about 5 to about 40% of the calcium hydroxide to calcium carbonate. Insofar as the carbonation is effected to about 5 to about 40%, the suspension can be passed downward through the reactor in any manner as by spraying or by being caused to flow downward through a charging column or column equipped with trays. In view of equipment cost and ease of operation, however, the spray method is desirable. Accordingly the present process will be described below as practiced by the spray method. The suspension is sprayed preferably in droplets of about 0.2 to about 1.0 mm in diameter. When less than 0.01 part by weight of the additive is used in the first step per 100 parts by weight of calcium hydroxide, the calcium carbonate particles finally obtained will not have satisfactory projections, whereas when the amount exceeds 20 parts by weight, large agglomerates will be finally formed in place of the desired crystalline particles. It is more preferable to use about 0.05 to about 15 parts by weight of the additive per 100 parts by weight of the calcium hydroxide. If the aqueous suspension has a calcium hydroxide concentration of less than 5% by weight or a temperature of lower than 30° C., it is more likely that the calcium carbonate finally obtained is in the form of block-like secondary particles which are agglomerates of chain particles. If the calcium hydroxide concentration is above 15% by weight, difficulty is encountered in spraying the suspension in uniform droplets, permitting formation of chain particles and agglomerates of such particles. When the suspension has a temperature of higher than 80° C., there occurs a pronounced tendency that the product will contain large particles, and particles with projections of very small L/D. With droplets larger than 1.0 mm in diameter, the reaction fails to proceed uniformly, whereas droplets smaller than 0.2 mm tend to flow out from the reactor as entrained in the carbon dioxide-containing gas. The carbon dioxide-containing gas, if passed through the reactor at a superficial velocity of lower than 0.02 m/sec, will not permit the reaction to proceed smoothly, whereas velocities higher than 1.0 m/sec tend to permit droplets of the suspension to flow out from the system. The carbon dioxide concentration of the gas, although not particularly limited, is likely to impede rapid reaction when below 10% by volume, while concentrations above 40% by volume will not noticeably favor the reaction. In view of reactivity and economy, it is more preferable that the carbon dioxide concentration be about 20 to about 35% by volume.

(ii) In the second step, the mixture resulting from the first step is sprayed into a second reactor in droplets of about 1.0 to about 2.0 mm in diameter at a temperature of about 30 to about 80° C. in countercurrent relation to a carbon dioxide-containing gas passed upward through the reactor at a superficial velocity of about 1.0 to about 3.0 m/sec to complete the carbonation. Since the reaction has already proceeded, the mixture is sprayed in larger droplets, with the gas passed at a correspondingly higher superficial velocity. The calcium carbonate B produced according to this invention is collected by dewatering the reaction mixture in a usual manner as by a filter press, vacuum filter or the like, drying and dividing the resulting solids into loose particles and classifying the product.

Filled paper can be produced with the use of the calcium carbonate A or B in the same manner as with the use of known pigments and fillers, for example, by beating with a beater a mixture of pulp, the calcium carbonate A or B and additives such as sizing agents, further beating or refining the resulting slurry with a refiner, making the stock into a sheet by a Fourdrinier machine, cylinder machine or the like, dewatering and drying the sheet, finishing the sheet with a calender roll and winding the paper into a roll. The calcium carbonate A or B is incorporated into paper usually in an amount of 5 to 50%, preferably 10 to 30%, of the dry weight of the paper obtained although the amount is greatly variable with the kind, use and thickness of paper. According to this invention, both calcium carbonate A and B are usable in combination, and further small amounts of clay, titanium white, barium sulfate, calcium carbonate in the form of spindle-shaped crystals, etc. are also usable conjointly.

EXAMPLE 1 TO 4

A mixture of 60 parts by weight of bleached hardwood pulp and 40 parts by weight of bleached softwood pulp is beaten to a freeness of 300 ml Canadian Standard Freeness as determined according to JIS (Japanese Industrial Standards) P 8121, "Testing Method for Freeness of Pulp." The pigment listed in Table 5 is added to the resulting slurry, and the stock is made into filled paper according to JIS P 8209, "Method of Preparing Hand Sheets for Pulp Testing."

The paper contains the pigment in an amount of 25% of the dry weight of the paper.

Table 5 shows the opacity, stiffness and brightness of the paper.

Table 6 shows the physical properties of the calcium carbonates A-1, A-2, B-1 and B-2 used.

TABLE 5

| | Pigment (calcium carbonate) | Opacity[1] (%) | Stiffness[2] ($cm^3/100$) | Brightness[3] (%) |
|---|---|---|---|---|
| Ex. 1 | A-1 | 90 | 24.0 | 87.2 |
| Ex. 2 | A-2 | 91 | 23.5 | 87.3 |
| Ex. 3 | B-1 | 92 | 23.0 | 87.5 |
| Ex. 4 | B-2 | 93 | 22.5 | 87.8 |
| Comp. Ex. 1 | Commercial product[4] | 75 | 20.0 | 84.8 |
| Comp. Ex. 2 | None[5] | 70 | 25.0 | 79.5 |

Note
[1]According to JIS P 8138, "Testing Method for Opacity of Paper."
[2]According to JIS P 8143, "Testing Method for Stiffness of Paper by Self-Bending."
[3]According to JIS P 8123, "Testing Method for Brightness by Hunter of Paper and Pulp."
[4]Spindle-shaped calcium carbonate crystals, 1 to 3 μm in mean size, presently widely used as pigment for filling paper.
[5]The paper weighs 50 $g/m^2$.

TABLE 6

| | Calcium Carbonate | | | |
|---|---|---|---|---|
| | A-1 | A-2 | B-1 | B-2 |
| Projections | | | | |
| Number | 3200 | 900 | 1800 | 3500 |
| Length (L, μm) | 1.52 | 0.75 | 1.50 | 1.80 |
| Diam. (D, μm) | 0.19 | 0.15 | 0.15 | 0.10 |
| Aspect ratio (L/D) | 8 | 5 | 10 | 18 |
| Water absorption (g/g) | 1.10 | 0.95 | 1.2 | 2.0 |
| Angle of repose (deg) | 38 | 35 | 50 | 55 |
| Specific surface area ($m^2/g$) | 12 | 10 | 11 | 17 |
| Oil absorption (ml/100 g) | 54 | 48 | 65 | 80 |
| Void volume (ml/g) | 1.5 | 1.3 | 1.9 | 2.2 |
| Sedimentation volume (ml/60 min) | 30 | 27 | 64 | 68 |
| Hiding power ($cm^2/g$) | 30 | 38 | 43 | 48 |
| Viscosity (cps/60 wt. %) | 80 | 60 | 150 | 800 |

Table 5 reveals that the filled paper prepared according to this invention is much superior in opacity, stiffness and brightness to the paper incorporating spindle-shaped crystals of the commercial calcium carbonate.

We claim:

1. A filled paper characterized in that the paper is filled with at least one of (i) a calcium carbonate in the form of particles comprising a core about 0.5 to about 6.5 μm in average diameter and about 100 to about 4000 projections formed on the surface of the core and having a length (L) of about 0.25 to about 2.00 μm, a diameter (D) of about 0.08 to about 0.20 μm and an aspect ratio (L/D) of about 3 to about 10, the calcium carbonate having a void volume of about 1.0 to about 1.8 ml/g and an oil absorption of about 45 to about 60 ml/100 g, and (ii) a calcium carbonate in the form of particles comprising a core about 0.2 to about 2.0 μm in average diameter and about 100 to about 4000 projections formed on the surface of the core and having a length (L) of about 0.15 to about 4.00 μm, a diameter (D) of about 0.5 to about 0.20 μm and an aspect ratio (L/D) of about 3 to about 20, the calcium carbonate having a void volume of about 1.8 to about 3.3 ml/g and an oil absorption of about 50 to about 100 ml/100 g, wherein said calcium carbonate is present in an amount of at least 5% of the dry weight of the paper obtained.

2. A filled paper characterized in that the paper is filled with at least one of (i) a calcium carbonate in the form of particles comprising a core about 0.5 to about 6.5 μm in average diameter and about 100 to about 4000 projections formed on the surface of the core and having a length (L) of about 0.25 to about 2.00 μm, a diameter (D) of about 0.08 to about 0.20 μm and an aspect ratio (L/D) of about 3 to about 10, the calcium carbonate having a void volume of about 1.0 to about 1.8 ml/g and an oil absorption of about 45 to about 60 ml/100 g, and (ii) a calcium carbonate in the form of particles comprising a core about 0.2 to about 2.0 μm in average diameter and about 100 to about 4000 projections formed on the surface of the core and having a length (L) of about 0.15 to about 4.00 μm, a diameter (D) of about 0.05 to about 0.20 μm and an aspect ratio (L/D) of about 3 to about 20, the calcium carbonate having a void volume of about 1.8 to about 3.3 ml/g and an oil absorption of about 50 to about 100 ml/100 g, wherein said calcium carbonate is present in an amount of up to 50% of the dry weight of the paper obtained.

3. A filled paper according to claim 1 or 2, in which the calcium carbonate is in an amount of 5 to 50% of the dry weight of the paper obtained.

4. A filled paper according to claim 2, in which the calcium carbonate is in an amount of 10 to 30% of the dry weight of the paper obtained.

* * * * *